United States Patent [19]

Mathews

[11] 4,165,802

[45] Aug. 28, 1979

[54] SLOT MACHINE COIN GUIDE

[76] Inventor: John D. Mathews, 3024 Holly Hill, Las Vegas, Nebr. 89104

[21] Appl. No.: 884,629

[22] Filed: Mar. 6, 1978

[51] Int. Cl.[2] ..... G07F 1/04

[52] U.S. Cl. ..... 194/1 K

[58] Field of Search ..... 194/1 K, 1 E; 232/7, 232/44, 55; 194/1 A; 133/1 R

[56] References Cited

U.S. PATENT DOCUMENTS

| | | | |
|---|---|---|---|
| 2,642,073 | 6/1953 | Ingraham | 232/7 |
| 2,729,391 | 1/1956 | Staubel et al. | 232/7 |

*Primary Examiner*—S. Tollberg

*Attorney, Agent, or Firm*—Clarence A. O'Brien; Harvey B. Jacobson

[57] ABSTRACT

An upstanding tubular member is provided having upper and lower portions each including front and rear walls interconnected along corresponding opposite sides by means of side walls. The lower portion of the tubular member may be downwardly telescoped over an upwardly projecting coin inlet portion of a machine for support of the tubular member from the coin inlet portion and the front wall of the tubular member upper portion includes downwardly and rearwardly inclined first guide ribs terminating downwardly above the tubular member lower portion and forwardly of the innermost surfaces of the rear wall of the tubular member lower portion. In addition, the rear wall of the upper the upper tubular member upper portion includes forwardly and downwardly inclined second guide ribs terminating downwardly above and rearwardly of the first guide ribs and the front wall of the tubular member lower portion includes upstanding third guide ribs inclined rearwardly and downwardly and forming integral downward extensions of the first guide ribs.

11 Claims, 4 Drawing Figures

SLOT MACHINE COIN GUIDE

BACKGROUND OF THE INVENTION

Various forms of slot machines include upstanding coin receiving inlet portions upwardly through which coin receiving slots extend and coins to be deposited in these machines must be maneuvered into position for falling by gravity into the coin receiving slots. When such coin receiving inlet portions for slot machines are utilized in gambling casinos, the normal tendency of the high level of activity in a casino to distract the player of a slot machine and the fact that the player of a slot machine is sometimes holding a drink in one hand causes casual attempts to deposit coins in the slot machines to be sometimes ineffective with the result that the coins attempted to be deposited into the slot machines are occassionally dropped on the floor of the casino necessitating that the player of a slot machine retrieve his or her dropped coins from the floor. In addition to the retrieval of dropped coins sometimes being embarrassing to a slot machine player, the act of numerous slot machine players having to occasionally retrieve dropped coins from the floor in a crowded casino can have the effect of increasing the incidents of accidental body contact with other persons within the crowded casino. Accordingly, a need exists for structure whereby the depositing of coins within slot machines may be more readily accomplished without a slot machine player experiencing accidental droppage of coins.

Various forms of coin guide structures for coin receiving machines are disclosed in U.S. Pat. No. 1,182,963, 1,942,618, 2,729,391, and 4,044,875.

BRIEF DESCRIPTION OF THE INVENTION

The coin guide of the instant invention comprises an upstanding tubular member whose lower end may be downwardly telescoped over and supported from the upwardly projecting coin inlet portion of a slot machine. The upper end of the tubular guide is upwardly flared and includes coin guiding surface portions operative to guide a coin dropped into the upwardly flared upper end of the coin guide into correct position for dropping by gravity into the coin slot opening upwardly through the upwardly projecting inlet portion of the slot machine over which the lower end of the tubular guide is telescoped.

The main object of this invention is to provide a coin guide that may be utilized in conjunction with a slot machine, such as a one arm bandit, to assist the player of the slot machine in depositing coins into the machine with little chance of coins being deposited into the machine being accidentally dropped by the player.

Another object of this invention is to provide a coin guide in accordance with the preceding object and constructed in a manner whereby it may be utilized as a portable guide and successively moved from one slot machine to another by a player wishing to play more than one slot machine.

Another important object of this invention is to provide a coin guide having a location thereon upon which a suitable advertisement-type logo may be placed.

A final object of this invention is to provide a coin guide in accordance with the preceding objects and which will conform to conventional forms of manufacture, be of simple construction and be easy to use so as to provide a device that will be economically feasible, long lasting and relatively troublefree in operation.

These together with other objects and advantages which will become subsequently aopparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
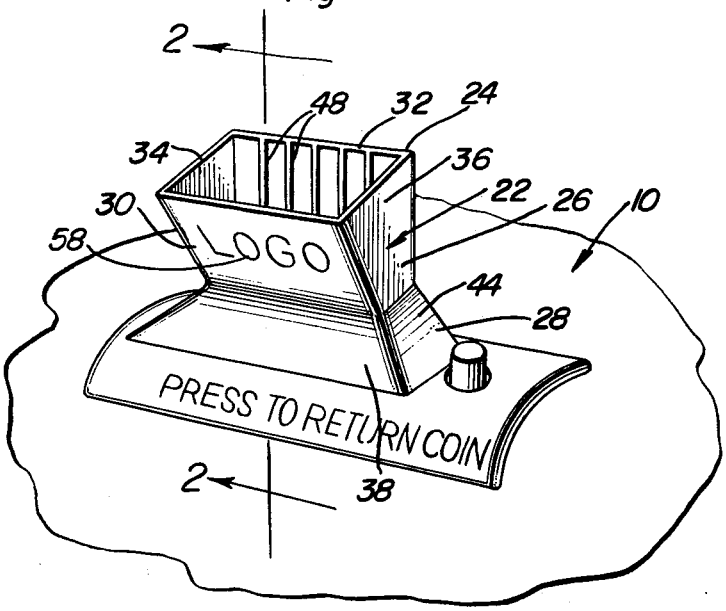
FIG. 1 is a perspective view of the coin guide of the instant invention in operative association with and supported from the upwardly projecting inlet portion the coin receiving structure of a slot machine.
Figure 2:
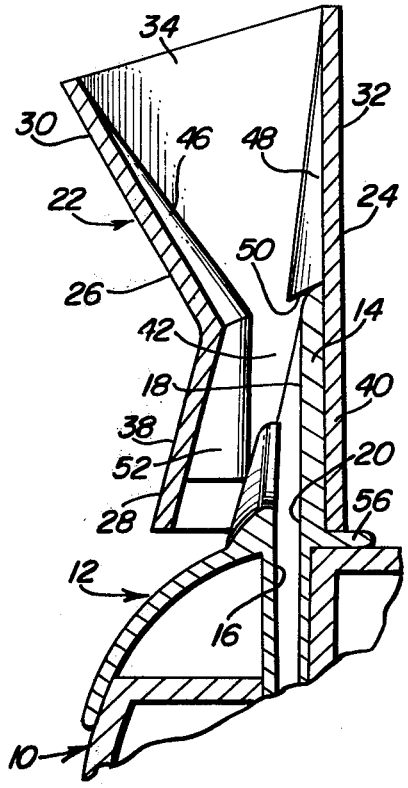
FIG. 2 is an enlarged fragmentary vertical sectional view taken substantially upon the plane indicated by the section line 2—2 of FIG. 1.
Figure 3:
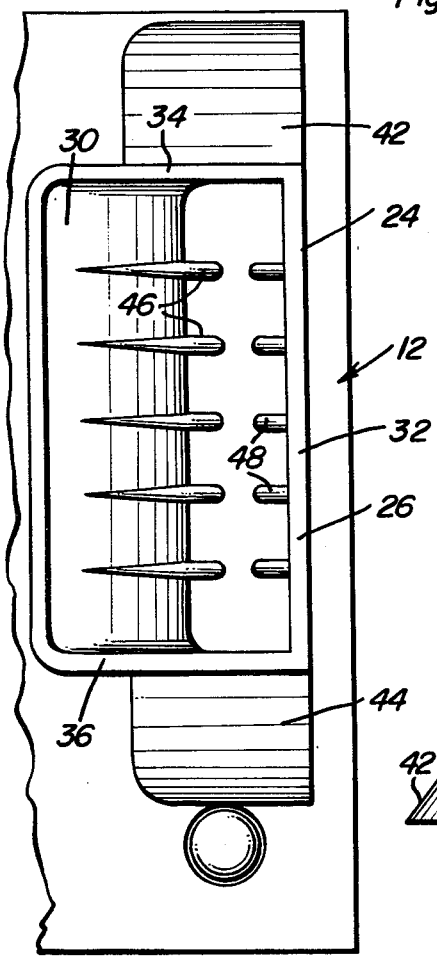
FIG. 3 is a fragmentary enlarged top plan view of the assemblage illustrated in FIG. 1.
Figure 4:
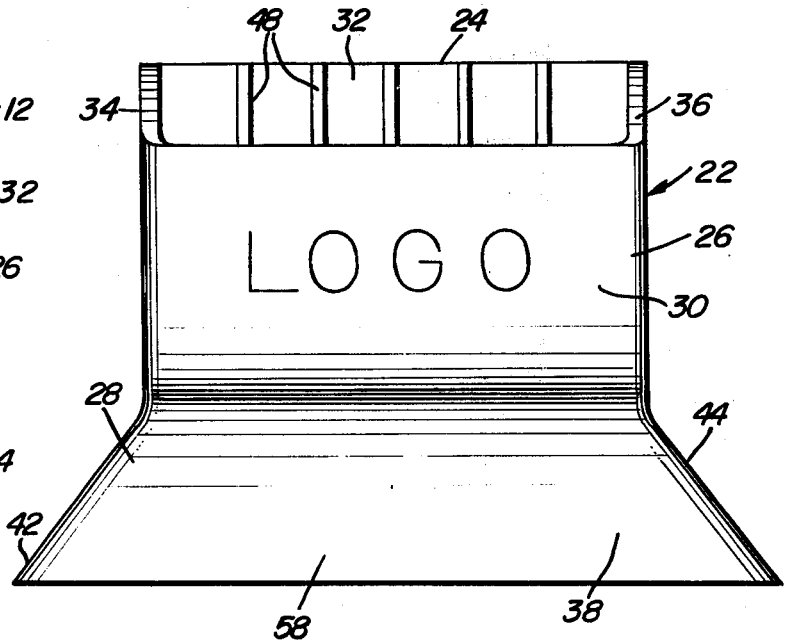
FIG. 4 is an enlarged front elevational view of the coin guide.

Referring now more specifically to the drawing, the numeral 10 generally designates a slot machine which may comprise a one-arm bandit. The machine 10 includes coin receiving structure referred to in general by the reference numeral 12 including an upwardly projecting inlet portion 14 upwardly through which an upstanding coin receiving slot 16 opens. The inlet portion 14 defines a forwardly facing upstanding guide surface 18 extending upwardly beyond the upper extremity of the slot 16 and comprising an upward extension of the rear side 20 of the slot 16.

Conventionally, an upstanding coin is laterally advanced from a position forwardly of the guide surface 18 toward and into abutting engagement with the latter and the coin may be thereafter released for falling by gravity into the upper end of the slot 16. However, as hereinbefore set forth, casual attempts to place a coin in the upper end of the slot 16 within an active and active and crowded casino can result in accidental droppage of the coin prior to it being properly vertically aligned with the slot 16, thereby resulting in the coin falling to the floor of the casino and the player of the machine 10 having to bend over and pick up the dropped coin.

In order to provide a means whereby players of slot machines may more readily place coins within the machines, the coin guide of the instant invention referred to in general by the reference numeral 22 is provided. The coin guide 22 comprises an upstanding tubular member 24 having upper and lower portions 26 and 28. The upper portion 26 includes front and rear walls 30 and 32 interconnected by means of opposite side walls 34 and 36 and the lower portion 28 includes front and rear walls 38 and 40 interconnected by opposite side walls 42 and 44.

The front and rear walls 38 and 40 of the lower portion 28 comprise downward extensions of the front and rear walls 30 and 32 of the upper portion 26 and the side walls 42 and 44 of the lower portion 28 define downward extensions of the side walls 34 and 36 of the upper portion 26. The rear walls 32 and 40 are coplanar and the front wall 30 is rearwardly and downwardly inclined, while the front wall 38 is forwardly and downwardly inclined. Further, the side walls 34 and 36 are substantially parallel while the side the side walls 42 and 44 are downwardly convergent.

The inner surface of the front wall 30 includes transversely spaced upstanding and inwardly projecting rearwardly and downwardly inclined ribs 46 whose rear surfaces define rearwardly and downwardly inclined first guide surface portions. The rear wall 32 includes downwardly and forwardly inclined upstanding and forwardly projecting ribs 48 spaced transversely thereof whose forward extremities define forwardly and downwardly inclined second guide surface portions. The ribs 46 terminate downwardly at the lower extremity of the upper portion 26 and lower ends of the ribs 48 terminate downwardly a spaced distance above the lower ends of the ribs 46. Further, the lower ends of the ribs 48 define downwardly facing abutment surfaces 50 for abutting engagement with the upper end of the inlet portion 14 when the lower portion 28 is downwardly telescoped over the inlet portion 14. The inner surface of the front wall 38 of the lower portion 28 includes upstanding rearwardly projecting ribs 52 spaced transversely thereof and the rearward extremities of the ribs 52 define third downwardly and rearwardly inclined guide surface portions 14 whose upper ends form downward extensions of the first downwardly and rearwardly inclined guide surface portions defined by the ribs 46, the ribs 46 and 52 being integral.

The side walls 42 and 44 are downwardly divergent for abutting engagement with opposing upwardly and outwardly facing opposite side surfaces of the upwardly projecting inlet portion 14 and the lower end of the tubular member 24 may abut against a mounting flange 56 for the inlet portion 14. In operation, a coin to be deposited into the coin receiving structure 12 is dropped downwardly into the upwardly flared upper portion 26 of the guide 22 and the coin dropped into the upper portion 26 is engaged by the ribs 46 and guided by the lower ends of the ribs 48 for downward movement in a direction causing the dropped coin to be fed accurately into the upper end of the slot 16. The ribs 48 insure that coins dropped into the guide 22 to not abut and jam against the upper extremity of the inlet portion 14 and the ribs 52 serve to assist in properly positioning the guide 22 relative to the inlet portion 14 and to further guide coins against downward movement past the upper end of the slot 16 formed of the portion 14. The coin guide 22 may be readily removed from engagement with the coin receiving structure 12 merely by upwardly displacing the coin guide from the machine 10 and the guide 22 may thereafter be downwardly displaced over the coin receiving structure of the next slot machine to be played.

The forward surface of the front wall 38 of the lower portion 28 is flat and suitable for having an advertisement logo 58 thereon. In this manner, an advertising casino may provide its slot machine players with coin guides and the slot machine players may so use the coin guides on slot machines in other casinos that they may wish to visit.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A coin guide for a machine having a coin receiving structure of the type including an upwardly projecting inlet portion upwardly through which an upstanding coin receiving slot opens and defining an upstanding forwardly facing guide surface extending upwardly beyond the upper extremity of said slot and comprising an upward extension of one side of said slot against which an upstanding coin to be deposited in said slot may be horizontally laterally advanced from a position forwardly of said guide surface prior to release of said coin for falling by gravity into the upper end of said slot, said guide including an upstanding tubular member having upper and lower portions each including front and rear walls interconnected along corresponding opposite sides by means of side walls, said lower portion being adapted to be downwardly telescoped over said inlet portion for support of said tubular member therefrom and with the upper and lower extremities of said lower and upper portions generally horizontally registered with an upper portion of said guide surface above said slot, said front wall of said tubular member upper portion including downwardly and rearwardly inclined first guide surface portions terminating downwardly above said tubular member lower portion forwardly of the innermost surfaces of the rear wall of said tubular member lower portion.

2. The combination of claim 1 wherein said rear wall of said tubular member upper portion includes forwardly and downwardly inclined second guide surface portions terminating downwardly above and rearwardly of said first guide surface portions.

3. The combination of claim 2 wherein said second guide surface portions terminate downwardly in rearwardly directed downwardly facing abutment surface portions for abutting engagement with the portion of said inlet portion defining the upper extremity of said guide surface.

4. The combination of claim 2 wherein said front wall of said tubular member lower portion includes downwardly and rearwardly inclined third guide surface portions terminating downwardly above the lower end of said tubular member lower portions.

5. The combination of claim 4 wherein the lower extremities of the first guide surface portions terminate at the upper ends of the third guide surface portions.

6. The combinations of claim 1 wherein said first guide surface portions are defined by upstanding and rearwardly projecting ribs spaced across the inner surface of the front wall of said tubular member upper portion.

7. The combination of claim 6 wherein said rear wall of said tubular member upper portion includes forwardly and downwardly inclined second guide surface portions terminating downwardly above and rearwardly of said first guide surface portions.

8. The combination of claim 7 wherein said second guide surface portions are defined by upstanding and forwardly projecting ribs spaced across the inner surface of the rear wall of said tubular member upper portion.

9. The combination of claim 8 wherein said second guide surface portions terminate downwardly in rearwardly directed downwardly facing abutment surface portions for abutting engagement with the portion of said inlet portion defining the upper extremity of said guide surface, said abutment surface portions defining the lower ends of said forwardly projecting ribs.

10. The combination of claim 9 wherein said front wall of said tubular member lower portion includes downwardly and rearwardly inclined third guide surface portions terminating downwardly above the lower end of said tubular member lower portions.

11. The combination of claim 10 wherein the rearwardly projecting ribs on the front wall of said tubular member lower portion define integral downward extensions of the lower ends of the rearwardly projecting ribs on the front wall of said tubular member upper portion.

* * * * *

UNITED STATES PATENT AND TRADEMARK OFFICE

CERTIFICATE OF CORRECTION

PATENT NO. : 4,165,802

DATED : August 28, 1979

INVENTOR(S) : JOHN D. MATHEWS

It is certified that error appears in the above-identified patent and that said Letters Patent are hereby corrected as shown below:

In the front page, in the inventor's address, delete "Nebr." and substitute --Nevada--.

Signed and Sealed this

*Twenty-second* Day of *January 1980*

[SEAL]

*Attest:*

SIDNEY A. DIAMOND

*Attesting Officer*

*Commissioner of Patents and Trademarks*